US009531144B2

(12) United States Patent
Tsai et al.

(10) Patent No.: US 9,531,144 B2
(45) Date of Patent: Dec. 27, 2016

(54) ELECTRICAL PLUG CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Ya-Fen Kao, New Taipei (TW); Yang-Yang Zhou, New Taipei (TW); Long-Fei Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/137,399

(22) Filed: Apr. 25, 2016

(65) Prior Publication Data

US 2016/0315431 A1 Oct. 27, 2016

(30) Foreign Application Priority Data

Apr. 24, 2015 (CN) ..... 2015 1 0198488

(51) Int. Cl.

| | |
|---|---|
| ***H01R 12/24*** | (2006.01) |
| ***H01R 24/64*** | (2011.01) |
| ***H01R 13/405*** | (2006.01) |
| ***H01R 13/658*** | (2011.01) |
| *H01R 107/00* | (2006.01) |
| *H01R 12/00* | (2006.01) |
| *H01R 13/6585* | (2011.01) |

(52) U.S. Cl.

CPC ..... *H01R 24/64* (2013.01); *H01R 13/405* (2013.01); *H01R 13/658* (2013.01); *H01R 9/09* (2013.01); *H01R 13/6585* (2013.01); *H01R 2107/00* (2013.01)

(58) Field of Classification Search

None

See application file for complete search history.

(56) References Cited

U.S. PATENT DOCUMENTS

| | | | | |
|---|---|---|---|---|
| 9,231,356 | B1 * | 1/2016 | Ju | H01R 24/78 |
| 2015/0244111 | A1 * | 8/2015 | Ju | H01R 13/6585 439/607.05 |
| 2015/0318646 | A1 * | 11/2015 | Little | H01R 4/023 439/78 |
| 2016/0099524 | A1 * | 4/2016 | Hack | H01R 13/6583 439/607.55 |

* cited by examiner

*Primary Examiner* — Tho D Ta

(74) *Attorney, Agent, or Firm* — Muncy, Geissler, Olds & Lowe, P.C.

(57) ABSTRACT

An electrical plug connector includes a metallic shell, an insulated housing, and a plurality of plug terminals. The insulated housing is received in the metallic shell. The insulated housing includes a first groove and a plurality of second grooves. The plug terminals are held in the insulated housing in a single row manner. Each of the plug terminals includes a flexible contact portion, a body portion, and a plurality of cut portions. The flexible contact portion is extending backward from the body portion in the front-to-rear direction and protruded from the insulated housing. The cut portions are at the body portion and correspond to the first groove, and the flexible contact portions respectively correspond to the second grooves.

11 Claims, 7 Drawing Sheets

ELECTRICAL PLUG CONNECTOR

CROSS-REFERENCES TO RELATED APPLICATIONS

This non-provisional application claims priority under 35 U.S.C. §119(a) on Patent Application No. 201510198488.8 filed in China, P.R.C. on 2015 Apr. 24, the entire contents of which are hereby incorporated by reference.

FIELD OF THE INVENTION

The instant disclosure relates to an electrical connector, and more particular to an electrical plug connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical plug connector includes a plastic core, an outer iron shell enclosing out of the plastic core, and upper and lower plug terminals at the upper surface and lower surface of the plastic core.

For a conventional USB type-C electrical plug connector, because of the small sized terminals and small distance between the terminals, the terminals cannot be combined with the plastic core by one-time insert-molded. Hence, the upper plug terminals and the lower plug terminals are respectively assembled on the plastic core. Nevertheless, the plastic core would have terminal grooves for positioning the terminals. As a result, the manufacturing time and cost of the conventional USB type-C electrical plug connector increase.

SUMMARY OF THE INVENTION

Consequently, how to improve the existing electrical plug connector becomes an issue.

In view of these, an exemplary embodiment of the instant disclosure provides an electrical plug connector comprising a metallic shell, an insulated housing, and a plurality of plug terminals. The metallic shell defines a receiving cavity therein. The insulated housing is received in the receiving cavity. The insulated housing comprises a base portion, a tubular portion, and a mating room. The tubular portion comprises a first portion and a second portion. The tubular portion is extending from one side of the base portion, and the mating room is between the first portion and the second portion. The first portion has a first mating surface, the second portion has a second mating surface, and the first mating surface faces the second mating surface. The insulated housing further comprises a first groove and a plurality of second grooves. The first groove is formed on the first portion or the second portion. The first groove is adjacent to the base portion. The second grooves are formed on the first portion or the second portion, and the second grooves are adjacent to the opening of the mating room. The plug terminals comprise a plurality of signal terminals, at least one power terminal, and at least one ground terminal. The plug terminals are held in the insulated housing and at the first mating surface of the first portion or at the second mating surface of the second portion. Each of the plug terminals comprises a flexible contact portion, a body portion, a tail portion, and a plurality of cut portions. The body portion is held in the first portion or the second portion, the flexible contact portion is extending backward from the body portion in the front-to-rear direction and protruded from the insulated housing, and wherein the cut portions are at the body portion and correspond to the first groove, and the flexible contact portions respectively correspond to the second grooves.

In some embodiments, the insulated housing further comprises a positioning slot formed on the first portion or the second portion, and the positioning slot is located between the first groove and the second grooves. In addition, the body portions correspond to the positioning slot. Moreover, the plug terminals further comprise a plurality of extending portions. Each of the extending portions is extending from two adjacent side portions of two adjacent body portions.

In some embodiments, the plug terminals further comprise a terminal fixing portion extending from end portions of the tail portions. In addition, each of the plug terminals comprises a bent portion extending from the rear of the body portion to the tail portion.

In some embodiments, the electrical plug connector further comprises a rear block fixed at the rear of the insulated housing. The rear block comprises a plurality of through grooves, and the tail portions are held in the through grooves, respectively.

In some embodiments, the electrical plug connector further comprises a plurality of engaging portions respectively at two sides of the insulated housing, wherein each of the engaging portions comprises a hook portion and a protruded contact portion, the protruded contact portion is extending from the front of the hook portion and inserted into the side portion of the mating room, and the hook portions are respectively fixed with the two sides of the insulated housing.

In some embodiments, the electrical plug connector further comprises a plurality of abutting pieces respectively at the first portion and the second portion. Each of the abutting pieces comprises an abutting body and a bent contact portion extending from the front of the body. The abutting bodies are respectively fixed with the first portion and the second portion to be in contact with the metallic shell, the bent contact portions are extending toward the mating room.

In some embodiments, the electrical plug connector further comprises a circuit board fixed with the rear of the insulated housing, wherein one surface of the circuit board comprises a plurality of contacts in contact with the tail portions.

Based on the above, an electrical plug connector having single-row plug terminals is provided. The plug terminals can be assembled with the insulated housing via insert-molding techniques to reduce the manufacturing cost and manufacturing time of the electrical plug connector. In addition, the plug terminals are formed integrally as a whole because of the extending portions, and the extending portions may be cut by a pressing fixture inserting into one or more first groove of the insulated housing. Hence, the plug terminals can be separated from each other. In addition, when the electrical plug connector is mated with an electrical receptacle connector, the flexible contact portions of the plug terminals are in contact with the electrical receptacle connector, and the flexible contact portions are bent in the second grooves.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
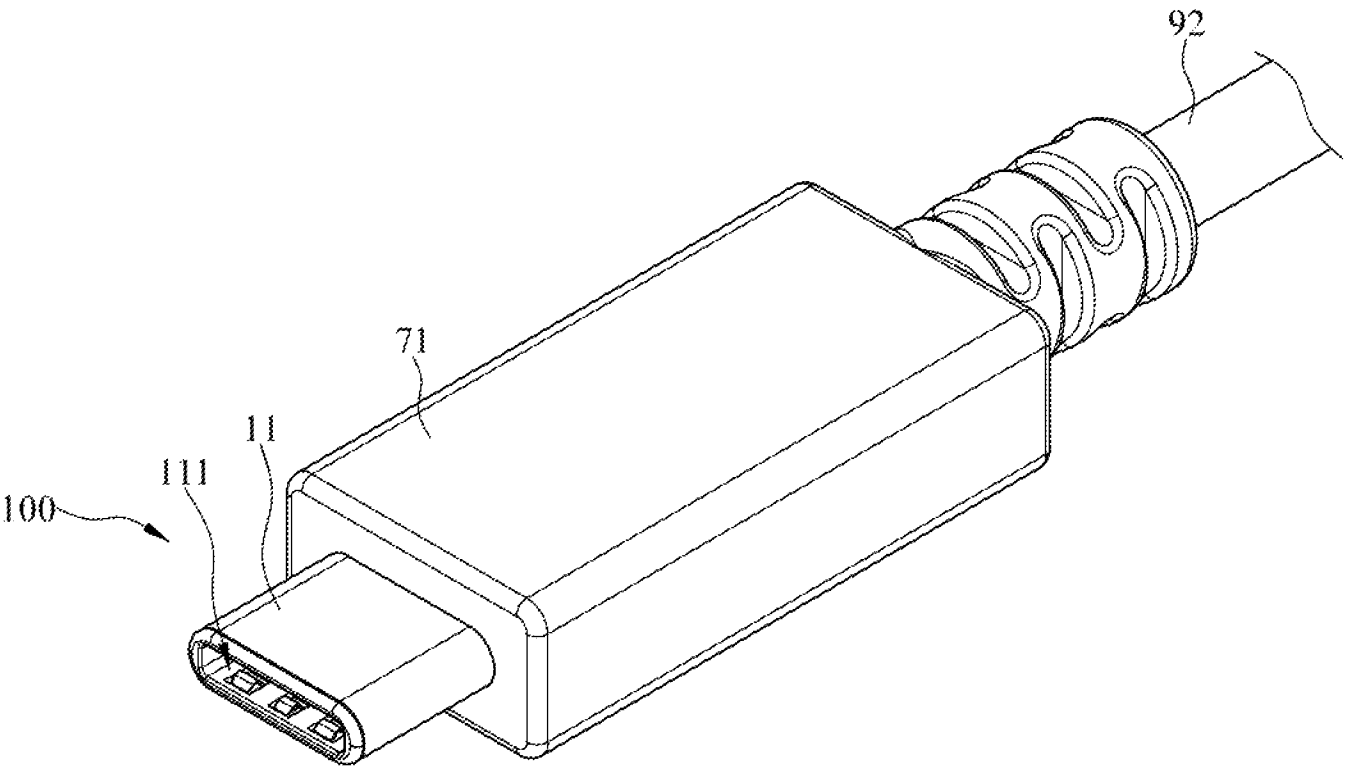
FIG. 1 illustrates a perspective view of an electrical plug connector of an exemplary embodiment of the instant disclosure.

FIG. 1 illustrates an exemplary embodiment showing an electrical plug connector 100 assembled with an enveloping shell 71 and a wire 92 to form a connection cable, but embodiments are not limited thereto. In some embodiments, the wire 92 may be omitted and the electrical plug connector 100 together with the enveloping shell 71 form a flash disk or a standing charging dock. In this embodiment, the electrical plug connector 100 can provide a reversible or dual orientation USB Type-C connector interface and pin assignments, i.e., a USB Type-C plug connector. In this embodiment, the electrical plug connector 100 comprises a metallic shell 11, an insulated housing 21, a plurality of plug terminals 31 (aligned in a single row).

Figure 2:
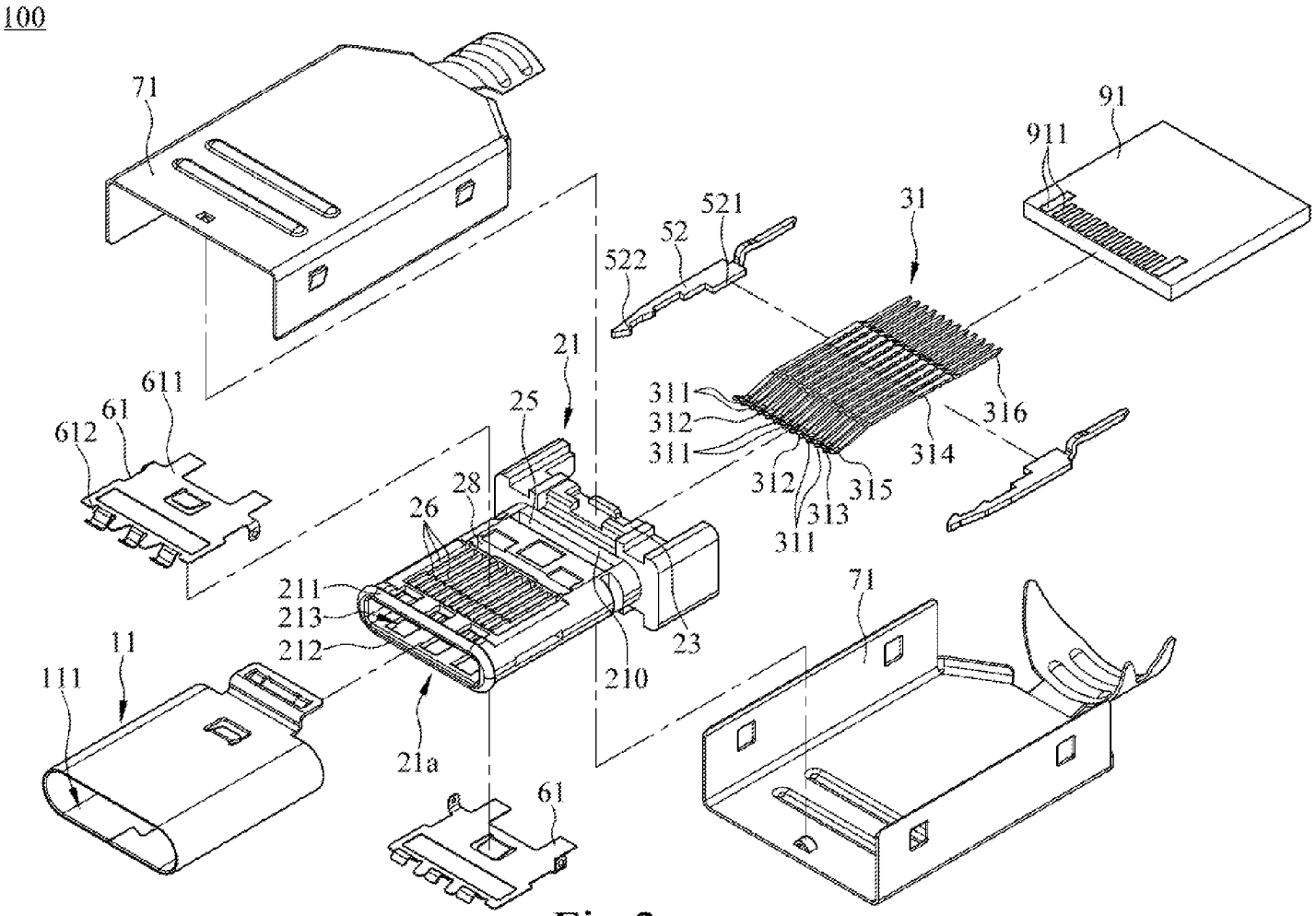
FIG. 2 illustrates an exploded view (1) of the electrical plug connector.
Figure 3:
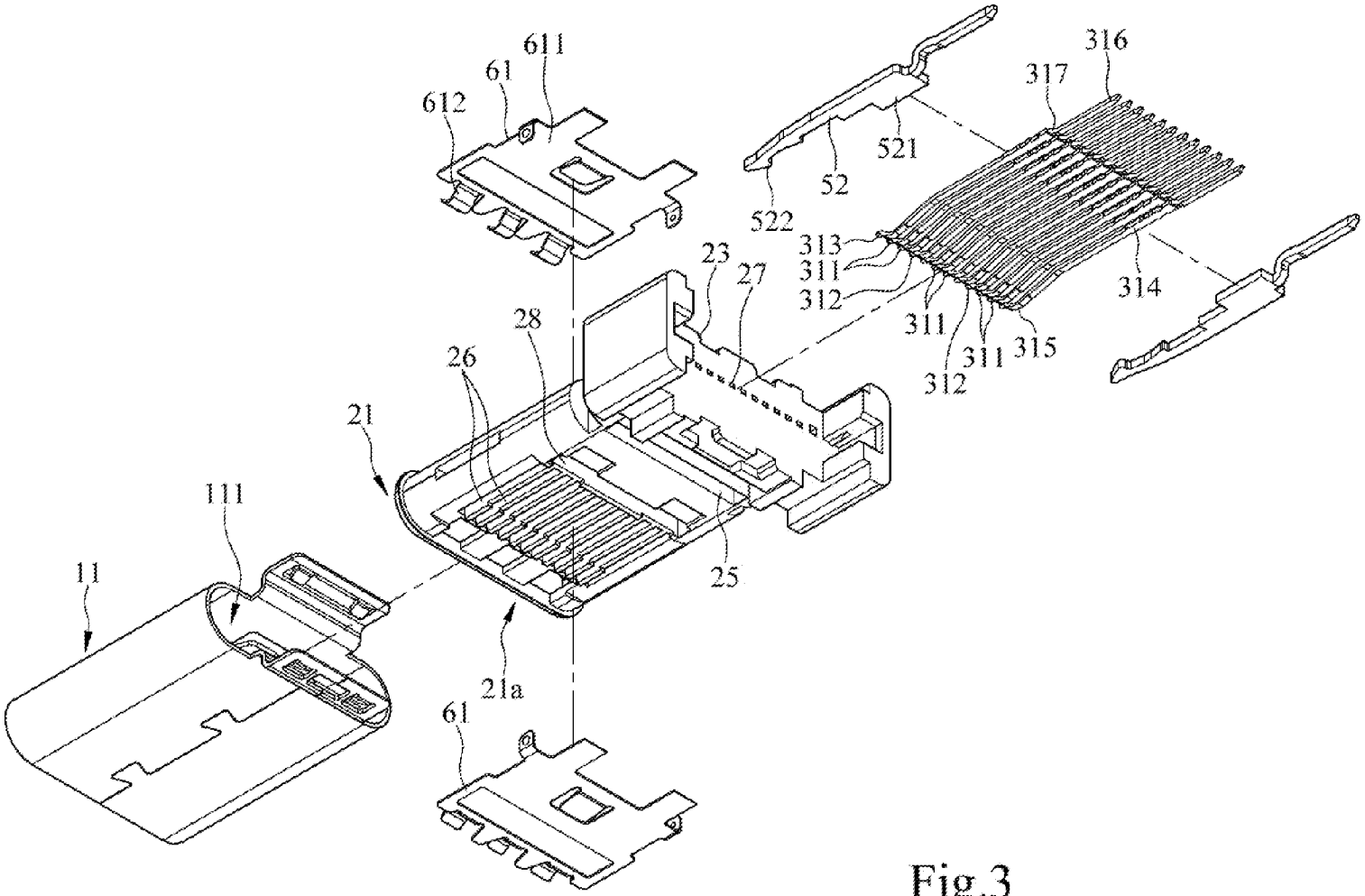
FIG. 3 illustrates an exploded view (2) of the electrical plug connector.

Please refer to FIGS. 2 to 3. The metallic shell 11 is a hollowed shell and defines a receiving cavity 111 therein. In this embodiment, the metallic shell 11 may be a multi-piece member or a unitary member. Moreover, an insertion opening, of oblong or rectangular shape, is formed at one side of the metallic shell 11, and the insertion opening communicates with the receiving cavity 111.

Please refer to FIG. 2 and FIG. 3. The insulated housing 21 is received in the receiving cavity 111 of the metallic shell 11. The insulated housing 21 comprises a base portion 210, a tubular portion 21*a*, and a mating room 213. Here, the base portion 210 and the tubular portion 21*a* are injection molded or the like to form the insulated housing 21. The tubular portion 21*a* is extending from one side of the base portion 210. In addition, the tubular portion 21*a* comprises a first portion 211 at the upper portion thereof and a second portion 212 at the lower portion thereof. In other words, the mating room 213 is between the first portion 211 and the second portion 212. The first portion 211 has a first mating surface and a first front lateral surface. The second portion 212 has a second mating surface and a second lateral surface. The first mating surface corresponds to (i.e., faces) the second mating surface.

Figure 7:
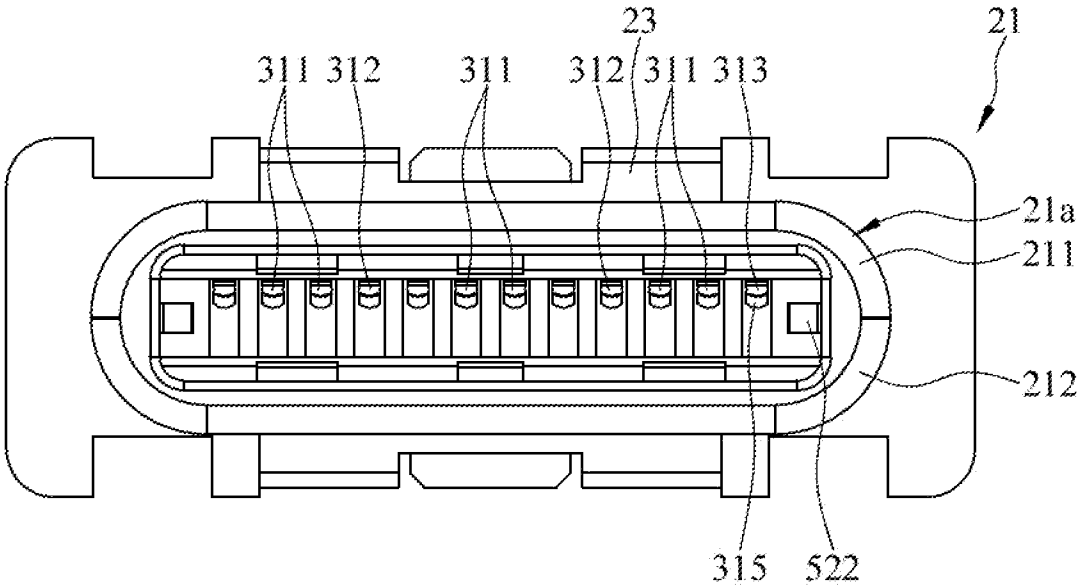
FIG. 7 illustrates a front view of the electrical plug connector.

Please refer to FIG. 2, FIG. 7, and Table 1 below. The plug terminals 31 are terminals aligned in a row. The plug terminals 31 comprise a plurality of signal terminals 311, at least one power terminal 312, and at least one ground terminal 313. As shown in FIG. 7 and Table 1, the plug terminals 31 comprise, from left to right, a ground terminal 313 (Gnd), a first pair of signal terminals 311 (RX2+−, differential signal terminals), a power terminal 312 (Power/VBUS), a detection terminal (CC), a second pair of signal terminals 311 (D+−, differential signal terminals), a secondary bus terminal (SBU1), another power terminal 312 (Power/VBUS), a third pair of signal terminals 311 (RX2+−, differential signal terminals), and another ground terminal 313 (Gnd). However, the pin assignment provided herein is as an illustrative purpose, but not a limitation of the electrical plug connector 100.

TABLE 1

| pin assignment of plug terminals 31 in a single row (twelve terminals) | | | | | | | | | | | |
|---|---|---|---|---|---|---|---|---|---|---|---|
| A12 | A11 | A10 | A09 | A08 | A07 | A06 | A05 | A4 | A03 | A02 | A1 |
| GND | RX2+ | RX2− | VBUS | SBU1 | D+ | D− | CC | VBUS | RX2+ | RX2− | GND |
| B1 | B02 | B03 | B04 | B05 | B06 | B07 | B08 | B9 | B10 | B11 | B12 |

In the aforementioned embodiment, the electrical plug connector 100 has twelve plug terminals 31 for USB 2.0 signal transmission, but embodiments are not limited thereto. In some embodiments, as shown in FIG. 2, FIG. 7, and Table 2, the first pair of signal terminals 311 (RX2+−), the third pair of signal terminals 311 (RX2+−), and the secondary bus terminal (SBU1) are omitted, the seven plug terminals 31 shown in Table 2 are provided for USB 2.0 signal transmission. In other words, according to embodiments of the instant disclosure, the electrical plug connector 100 comprises plug terminals 31 aligned in single row (either as upper plug terminals or as lower plug terminals). In addition, the number of the plug terminals 31 may be further reduced to seven terminals. In the illustrative embodiment, the plug terminals 31 are upper plug terminals of the electrical plug connector 100, but embodiments are not limited thereto. The plug terminals 31 may be the lower plug terminals of the electrical plug connector 100.

TABLE 2

| pin assignment of plug terminals 31 in a single row (seven terminals) | | | | | | | | | | | |
|---|---|---|---|---|---|---|---|---|---|---|---|
| A12 | A11 | A10 | A09 | A08 | A07 | A06 | A05 | A4 | A03 | A02 | A1 |
| GND | | | VBUS | | D+ | D− | CC | VBUS | | | GND |
| B1 | B02 | B03 | B04 | B05 | B06 | B07 | B08 | B9 | B10 | B11 | B12 |

Figure 4:
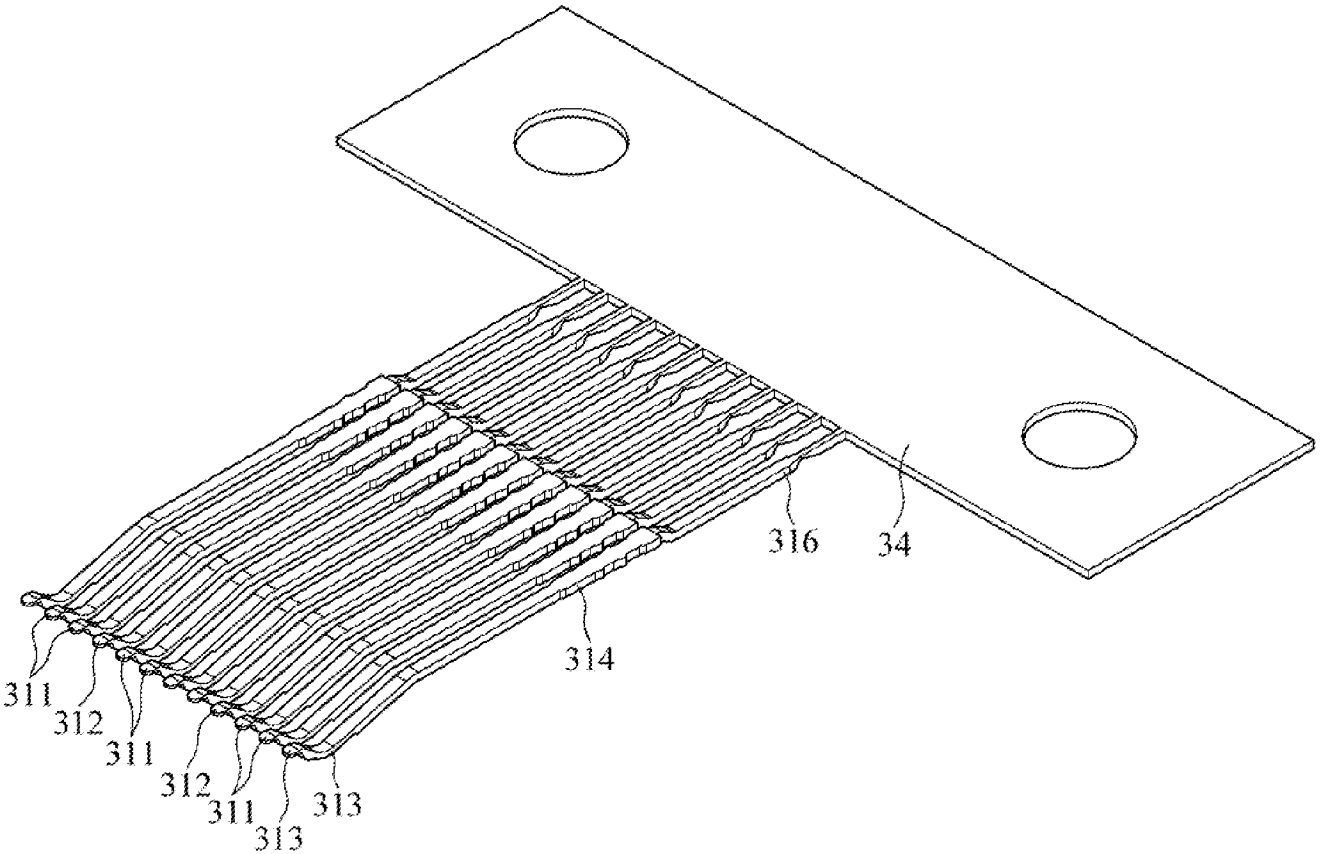
FIG. 4 illustrates a perspective view of the plug terminals and the terminal fixing portion of the electrical plug connector.

Please refer to FIGS. 2 to 4. Each of the plug terminals 31 comprises a flexible contact portion 315, a body portion 314, and a tail portion 316. For each of the plug terminals 31, the body portion 314 is held in the first portion 211, the flexible contact portion 315 is extending forward from the body portion 314 in the rear-to-front direction and partly exposed upon the first mating surface of the first portion 211, and the tail portion 316 is extending backward from the body portion 314 in the front-to-rear direction and protruded from the insulated housing 21. The plug terminals 31 partly project into the mating room 213 and are provided for transmitting first signals (i.e., USB 2.0 signals.). The tail portions 316 of the plug terminals 31 are extending from the rear of the insulated housing 21. According to embodiments of the instant disclosure, the plug terminals 31 can be provided for signal or power transmission based on different user requirements.

Figure 5:
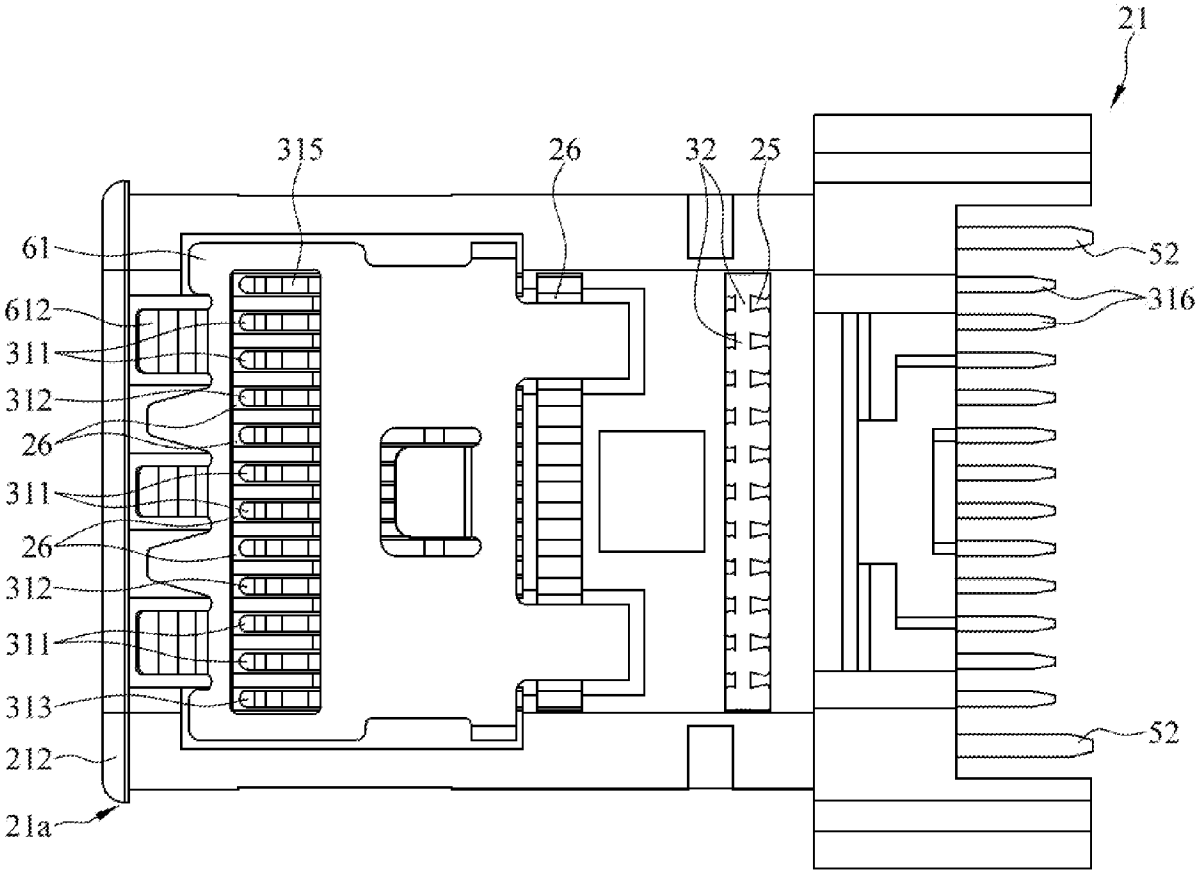
FIG. 5 illustrates a top view of the electrical plug connector with the extending portions.

The plug terminals 31 and the flexible contact portions 315 are formed by stamping a metallic sheet. Referring to FIG. 5, because the plug terminals 31 are integrated with each other via the extending portions 32, the structural strength of the flexible contact portions 315 can be improved. Hence, the flexible contact portions 315 would not be bent downward by the gravity force. In other words, the flexible contact portions 315 are integrated with each other via the extending portions 32, and the plug terminals 31 are integrated to form a unitary piece. Therefore, before the plug terminals 31 are formed with the insulated housing 21, the flexible contact portions 315 would not be bent downward by the gravity force because of the improved structural strength of the flexible contact portions 315. In addition, because the plug terminals 31 are connected with each other via the extending portions 32, the flexible contact portions 315 can be positioned properly during the insert-molding procedure.

Figure 6:
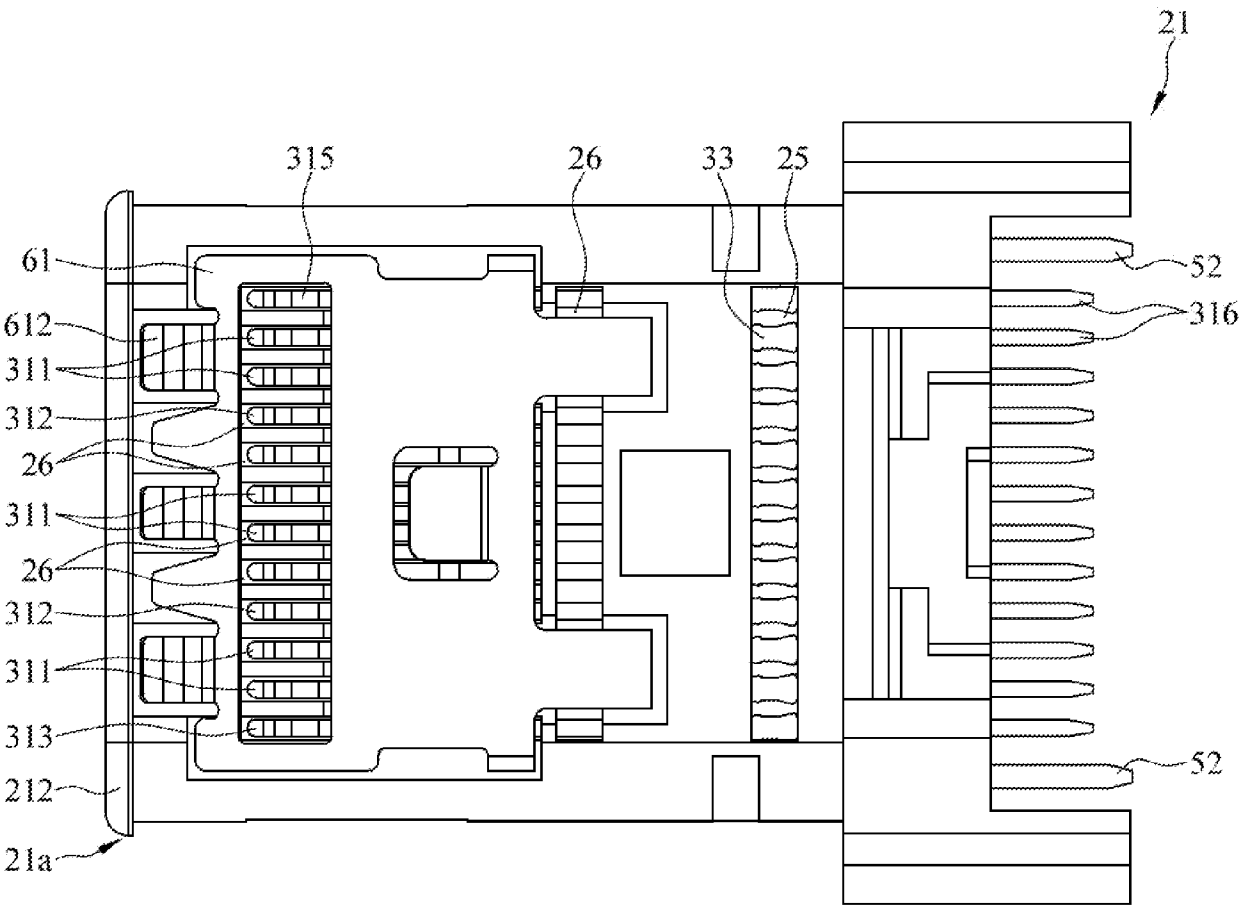
FIG. 6 illustrates a top view of the electrical plug connector without the extending portions.

In this embodiment, the plug terminals 31 are assembled on the first portion 211, but embodiments are not limited thereto. In some embodiments, the plug terminals 31 may be assembled on the second portion 212. The insulated housing 21 is assembled with the plug terminals 31 by insert-molded techniques or the like. As shown in FIG. 5, the plug terminals 31 are formed as a unitary piece via the extending portions 32 extending between the plug terminals 31. The insulated housing 21 comprises a first groove 25 on the rear of the first portion 211 and/or the rear of the second portion 212. That is, the first groove 25 may be on the rear of the first portion 211, the rear of the second portion 212, or both the rear of the first portion 211 and the rear of the second portion 212. The first groove 25 is adjacent to the base portion 210. The formation of the first groove 25 is described as below. In the insert molding procedure, the insulated housing 21 is received in a mold having a plurality of processing fixtures. After the insulated housing 21 is molded, the rear of the first portion 211 forms a first groove 25. In addition, the plug terminals 31 comprise a plurality of cut portions 33 formed with the body portions 314 and correspond to the first groove 25. Because the cut portions 33 correspond to the first groove 25, pressing fixtures can be inserted into the first groove 25 to cut the cut portions 33 (i.e., to break the extending portions 32). Therefore, as shown in FIG. 6, the plug terminals 31 can be separated with each other by breaking the extending portions 32. Accordingly, the plug terminals 31 can be manufactured in the insulated housing 21 conveniently.

In addition, the first groove 25 may be defined through the first portion 211 and the second portion 212. In such case, several pressing fixtures are respectively extending toward the top and the bottom of the extending portions 32 to cut the cut portions 33, but embodiments are not limited thereto. In some embodiments, the first groove 25 may be defined through the first portion 211 or the second portion 212, and a single set of pressing fixtures is extending toward the top or the bottom of the extending portions 32 to cut the cut portions 33.

Please refer to FIG. 4, the plug terminals 31 further comprise a terminal fixing portion 34 (i.e., a material band) extending from end portions of the tail portions 316. During the insert molding procedure of the insulated housing 21 and the plug terminals 31, the plug terminals 31 are positioned by the terminal fixing portion 34, so that the plug terminals 31 can be processed in the mold. After the insert-molded procedure, the plug terminals 31 are assembled with the insulated housing 21, and the terminal fixing portion 34 is cut by the pressing fixtures.

The insulated housing 21 comprises a plurality of second grooves 26, as shown in FIG. 2 and FIG. 6. The second grooves 26 may be directly formed on the first portion 211 or the second portion 212 after the insulated housing 21 is insert-molded. The second grooves 26 are adjacent to the opening of the mating room 213. In other words, the second grooves 26 are positioned corresponding to the plug terminals 31 to provide the flexible contact portions 315 with a swinging room. Specifically, when the flexible contact portions 315 are in contact with an electrical receptacle connector, the flexible contact portions 315 are bent in the second grooves 26.

Please refer to FIGS. 2 and 4. The insulated housing 21 further comprises a positioning slot 28 formed on the first portion 211 and/or the second portion 212. That is, the positioning slot 28 is on the first portion 211, the second portion 212, or both the first portion 211 and the second portion 212. The positioning slot 28 is located between the first groove 25 and the second grooves 26. In addition, the body portions 314 correspond to the positioning slot 28. Hence, during the insert-molded procedure, the fixtures are inserted into the positioning slot 28 to abut against the body portions 314 of the plug terminals 31, so that the body portions 314 of the plug terminals 31 can be well positioned during the insert-molded procedure and the body portions 314 cannot be moved freely. While in some embodiments, the positioning slot 28 may be provide for the insertion of the pressing fixtures. Accordingly, during the insert-molded procedure, the pressing fixtures can be inserted into the positioning slot 28 to cut the extending portions 32 of the plug terminals 31; in other words, the locations of the extending portions 32 may correspond to the positioning slot 28.

Please refer to FIGS. 2 and 3. The electrical plug connector 100 further comprises a rear block 23 fixed at the rear of the insulated housing 21. The rear block 23 comprises a plurality of through grooves 27, and the tail portions 316 are respectively held in the through grooves 27 and protruded out of the through grooves 27. A plurality of blocking members is formed between the through grooves 27 to separate the tail portions 316. In this embodiment, the rear block 23 and the insulated housing 21 may be integrally formed with each other; that is, the rear block 23 and the insulated housing 21 may be formed integrally by injection molded or the like. Alternatively, the rear block 23 and the insulated housing 21 may be separated pieces, and the rear block 23 is assembled at the rear of the insulated housing 21.

Please refer to FIGS. 1 and 2. In some embodiments, the electrical plug connector 100 is further connected to a wire 92. Specifically, when the tail portions 316 are exposed from the through grooves 27 of the rear block 23, sub wires of the wire 92 are soldered with the tail portions 316. In addition, the wire 92 may be a coaxial cable. Moreover, the wire 92 may be manufactured by hot bar, hot air drying, or ultrahigh frequency soldering.

Please refer to FIGS. 2 and 3. The electrical plug connector 100 further comprises a plurality of engaging portions 52 respectively at two sides of the insulated housing 21. The insulated housing 21 and the engaging portions 52 may be formed with each other by insert-molded technique or the like. Alternatively, the engaging portions 52 may be assembled with the insulated housing 21. In the latter configuration, the insulated housing 21 has through slots at two sides thereof for positioning the engaging portions 52, respectively. Each of the engaging portions 52 comprises a hook portion 521 and a protruded contact portion 522. The rears of the hook portions 521 are in contact with contacts 911 of a circuit board 91. The protruded contact portion 522 is extending from the front of the hook portion 521 and inserted into the side portion of the mating room 213. When the electrical plug connector 100 is mated with an electrical receptacle connector, buckling pieces at two sides of the electrical receptacle connector are in contact with the protruded contact portions 522. Therefore, the electrical plug connector 100 is positioned with the electrical receptacle connector by the engaging portions 52. Moreover, because the hook portions 521 are in contact with the metallic shell 11 and the rears of the hook portions 521 are in contact with the contacts 911 of the circuit board 91, noises can be grounded and conducted when the electrical plug connector 100 is mated with an electrical receptacle connector.

In some embodiments, an electrical receptacle connector to be mated with the electrical plug connector 100 has a plurality of upper-row receptacle terminals and a plurality of lower-row receptacle terminals, the electrical plug connector 100 may be mated with the electrical receptacle connector in dual mating directions, and the plug terminals 31 are in contact with the upper-row receptacle terminals or the lower-row receptacle terminals.

Therefore, the inserting orientation of the electrical plug connector 100 is not limited by the electrical receptacle connector. Additionally, in this embodiment, since the plug terminals 31 can be selectively provided at the first portion 211 or the second portion 212, the position of the plug terminals 31 at the first portion 211 is symmetrical about the position of the plug terminals 31 at the second portion 212 by taking the receiving cavity 111 as the symmetrical center. That is, pin-assignments of the plug terminals 31 at the first portion 211 and the plug terminals 31 at the second portion 212 are point-symmetrical with a central point of the receiving cavity 111 as the symmetrical center. Here, point-symmetry means that after the plug terminals 31 at the first portion 211 (or the plug terminals 31 at the second portion 212), are rotated by 180 degrees with the symmetrical center as the rotating center, the plug terminals 31 at the first portion 211 and the plug terminals 31 at the second portion 211 are virtually overlapped. Furthermore, the pin assignment of the plug terminals 31 at the first portion 211 is left-right reversal with respect to that of the plug terminals 31 at the second portion 212.

In this embodiment, each of the plug terminals 31 comprises a bent portion 317 extending from the rear of the body portion 314 to the tail portion 316. Hence, the distance between the tail portion 316 and the circuit board 91 can be adjusted. The tail portions 316 can be properly soldered with the contacts 911 of the circuit board 91; alternatively, the tail portions 316 can be directly soldered with the wires 92.

The electrical plug connector 100 further comprises a plurality of abutting pieces 61 respectively at the first portion 211 and the second portion 212. The abutting pieces 61 are rectangular shaped and symmetrical about each other. Each of the abutting pieces 61 comprises an abutting body 611 and a bent contact portion 612. The abutting body 611 is a sheet aligned horizontally. The abutting bodies 611 are respectively fixed with the first portion 211 and the second portion 212 to be in contact with the metallic shell 11. The bent contact portion 612 is extending from the front of the abutting body 611. The bent contact portion 612 is of V-shape from a cross-sectional view thereof. The bent contact portions 612 are extending toward the mating room 213 thru through grooves of the first portion 211 and the second portion 212. In addition, the bent contact portions 612 are adjacent to the insertion opening. When the electrical plug connector 100 is mated with an electrical receptacle connector, the abutting pieces 61 of the electrical plug connector 100 are in contact with connecting pieces of the electrical receptacle connector. In addition, the abutting pieces 61 are in contact with the metallic shell 11 via the abutting bodies 611, so that the metallic shell 11 of the electrical plug connector 100 and a metallic shell of the electrical receptacle connector are in contact with each other via the contact between the abutting pieces 61 and the connecting pieces. Therefore, noise can be grounded and conducted efficiently, and the electromagnetic interference (EMI) problems can be improved.

Based on the above, an electrical plug connector having single-row plug terminals is provided. The plug terminals can be assembled with the insulated housing via insert-molding techniques to reduce the manufacturing cost and manufacturing time of the electrical plug connector. In addition, the plug terminals are formed integrally as a whole because of the extending portions, and the extending portions may be cut by a pressing fixture inserting into one or more first groove of the insulated housing. Hence, the plug terminals can be separated from each other. In addition, when the electrical plug connector is mated with an electrical receptacle connector, the flexible contact portions of the plug terminals are in contact with the electrical receptacle connector, and the flexible contact portions are bent in the second grooves.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

a metallic shell defining a receiving cavity therein;

an insulated housing, received in the receiving cavity of the metallic shell, wherein the insulated housing comprises a base portion, a tubular portion, and a mating room, wherein the tubular portion comprises a first portion and a second portion, and the tubular portion is extending from one side of the base portion, and the mating room is between the first portion and the second portion, wherein the first portion has a first mating surface, the second portion has a second mating surface, and the first mating surface faces the second mating surface, and wherein the insulated housing further comprises a first groove and a plurality of second grooves, the first groove is formed on the first portion or the second portion, the first groove is adjacent to the base portion, the second grooves are formed on the first portion or the second portion, and the second grooves are adjacent to the opening of the mating room; and a plurality of plug terminals comprising a plurality of signal terminals, at least one power terminal, and at least one ground terminal, wherein the plug terminals are held in the insulated housing and at the first mating surface of the first portion or at the second mating surface of the second portion, wherein each of the plug terminals comprises a flexible contact portion, a body portion, a tail portion, and a plurality of cut portions, wherein the body portion is held in the first portion or the second portion, the flexible contact portion is extending forward from the body portion in the rear-to-front direction and partly exposed upon the first mating surface of the first portion or the second mating surface of the second portion, the tail portion is extending backward from the body portion in the front-to-rear direction and protruded from the insulated housing, and wherein the cut portions are at the body portions and correspond to the first groove, and the flexible contact portions respectively correspond to the second grooves.

2. The electrical plug connector according to claim 1, wherein the plug terminals further comprise a terminal fixing portion extending from end portions of the tail portions.

3. The electrical plug connector according to claim 1, wherein each of the plug terminals comprises a bent portion extending from the rear of the body portion to the tail portion.

4. The electrical plug connector according to claim 1, further comprising a rear block fixed at the rear of the insulated housing, wherein the rear block comprises a plurality of through grooves, and the tail portions are held in the through grooves, respectively.

5. The electrical plug connector according to claim 1, wherein the insulated housing further comprises a positioning slot formed on the first portion or the second portion, and the positioning slot is located between the first groove and the second grooves.

6. The electrical plug connector according to claim 5, wherein the body portions correspond to the positioning slot.

7. The electrical plug connector according to claim 1, wherein the plug terminals further comprise a plurality of extending portions, each of the extending portions is extending from two adjacent side portions of two adjacent body portions, and the cut portions are at the extending portions.

8. The electrical plug connector according to claim 6, wherein the plug terminals further comprise a plurality of extending portions, each of the extending portions is extending from two adjacent side portions of two adjacent body portions, and the cut portions are at the extending portions.

9. The electrical plug connector according to claim 1, further comprising a plurality of engaging portions respectively at two sides of the insulated housing, wherein each of the engaging portions comprises a hook portion and a protruded contact portion, the protruded contact portion is extending from the front of the hook portion and inserted into the side portion of the mating room, and the hook portions are respectively fixed with the two sides of the insulated housing.

10. The electrical plug connector according to claim 1, further comprising a plurality of abutting pieces respectively at the first portion and the second portion, wherein each of the abutting pieces comprises an abutting body and a bent contact portion extending from the front of the body, wherein the abutting bodies are respectively fixed with the first portion and the second portion to be in contact with the metallic shell, the bent contact portions are extending toward the mating room.

11. The electrical plug connector according to claim 1, further comprising a circuit board fixed with the rear of the insulated housing, wherein one surface of the circuit board comprises a plurality of contacts in contact with the tail portions.

* * * * *